US005950766A

United States Patent [19]

Oberleitner

[11] Patent Number: 5,950,766

[45] **Date of Patent: *Sep. 14, 1999**

[54] PROCEDURE FOR CLOSING AN ELEVATOR LANDING DOOR, AND A DOOR COUPLER

[75] Inventor: Rupert Oberleitner, Fohra, Austria

[73] Assignee: Kone Oy, Helsinki, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/711,902

[22] Filed: Sep. 12, 1996

[30] Foreign Application Priority Data

Sep. 13, 1995 [FI] Finland ..... 954305

[51] Int. Cl.[6] ..... B66B 13/12; E05C 7/06

[52] U.S. Cl. ..... 187/330; 187/319; 49/120

[58] Field of Search ..... 187/319, 330; 49/120

[56] References Cited

U.S. PATENT DOCUMENTS

| | | | |
|---|---|---|---|
| 2,458,702 | 1/1949 | Hains . | |
| 3,605,952 | 9/1971 | Lusti | 187/319 |
| 5,005,673 | 4/1991 | Rivera | 187/319 |
| 5,141,080 | 8/1992 | Kujala | 187/319 |
| 5,435,415 | 7/1995 | Kulak et al. | 187/330 |
| 5,690,188 | 11/1997 | Takakusaki et al. | 187/319 |

FOREIGN PATENT DOCUMENTS

| | | |
|---|---|---|
| 2053622 | 4/1971 | France . |
| 3-186589 | 8/1991 | Japan . |
| 5-338971 | 12/1993 | Japan . |

*Primary Examiner*—Janice L. Krizek
*Assistant Examiner*—Thuy V. Tran

[57] ABSTRACT

In the procedure for closing an elevator landing door (3,4), the landing door is coupled with the car door (1,2) by a door coupler, and the car door is moved by an actuator provided in conjunction with the elevator car. During the initial phase of the closing movement, the car door and landing door are moved at the same speed, but towards the end of the closing movement the landing door (3,4) is caused to move faster than the car door (1,2). Based on control by the car door movement, the coupling elements (5,6) of the door coupler are moved in the direction of the car door movement.

6 Claims, 4 Drawing Sheets

PROCEDURE FOR CLOSING AN ELEVATOR LANDING DOOR, AND A DOOR COUPLER

FIELD OF THE INVENTION

The present invention relates to a procedure for closing an elevator landing door and to a door coupler.

DESCRIPTION OF THE BACKGROUND ART

In elevators provided with automatic doors, the coupling between the car door and the landing door is generally effected using a door coupler which is mounted on the car door and engages counterparts mounted on the landing door by means of its gripping elements. The door coupler and the counterparts are so fitted relative to each other that, when the elevator car is moving past the landing door, the counterparts on the landing door are passed between the gripping elements of the door coupler. When the car is at a landing and the car doors are moving, the door coupler is in engagement with the counterparts. In this way, the landing door also moves when the car door is moved by a power means connected to the car door. Often the gripping elements are metal vanes projecting from the door coupler towards the landing door and forming a kind of a vertical slot which is open towards the landing door. The counterparts used often consist of rollers mounted on the landing door and projecting from the door towards the elevator shaft, the axle of the rollers being mounted in a position perpendicular to the plane of the door. The dual function of the door coupler in the closing of the door sometimes involves problems. In its dual function, the door coupler should move the landing door reliably to the end of its closing movement and, on the other hand, it should release the landing door before the elevator car starts moving. The requirement that these two functions be properly performed easily leads to complicated and expensive solutions, which may additionally involve limitations regarding the accomplishment of the transportation function of the entire elevator system, especially the transport capacity. Regarding the closing of automatic elevator doors, adequate closing of the landing doors is a question that deserves special attention. For example, the air currents generated in the elevator shaft may be a hindrance to proper closing of the landing door. In practice, to ensure that the door is properly closed, it is possible to use e.g. a so-called closing weight which draws the door by means of a rope into the closed position, or even a separate motor or other gear acting on the landing door. Such solutions may be noisy, take up space and involve expenses and additional maintenance. Using such solutions also easily leads to longer door closing times, which has a direct negative effect on the transport capacity of the elevator.

SUMMARY OF THE INVENTION

In order to overcome the aforesaid problems relating to the closing of landing doors and to improve the coupling between the car door and landing door, a procedure for closing an elevator landing door and a door coupler are presented as an invention.

The advantages provided by the invention include the following:

- The invention ensures a reliable coupling between the car door and landing door and complete closing of the doors.
- The drawbacks of inadequate or unsuccessful coupling, such as clatter and noise, interruption of door operation, the doors getting stuck, etc. are avoided.

- The whole process of closing and locking the door is accelerated, thus improving the performance of the elevator system as a whole.
- The door coupler vanes remain closed throughout the closing and opening movements of the landing door, holding the landing door in their grip, which results in accurate landing door movements.
- When the elevator doors are open, it is easy to achieve a good alignment between the door panels of the car door and the landing door as well as between the door jambs of the car door and landing door, giving a good visual impression.
- The invention is applicable to both side-opening and center-opening automatic elevator doors.
- The door coupler makes it easy to achieve a large clearance between the door coupler vanes and the rollers mounted on the landing doors. A large clearance allows e.g. the use of a softer spring suspension of the elevator car, which is an advantage in respect of travelling comfort. A large clearance could also permit a larger tolerance for deviations in the mounting of landing doors.
- Having a clear structure, the door coupler of the invention is easy to maintain. Its manufacturing and installation costs are low.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described by the aid of a few examples of its embodiments by referring to the attached drawings which are given by way of illustration only, and thus are not limitative of the present invention, and in which.

DETAILED DESCRIPTION OF THE PREFERRED EMBODIMENTS

Figures 1, 2, 3, 4:
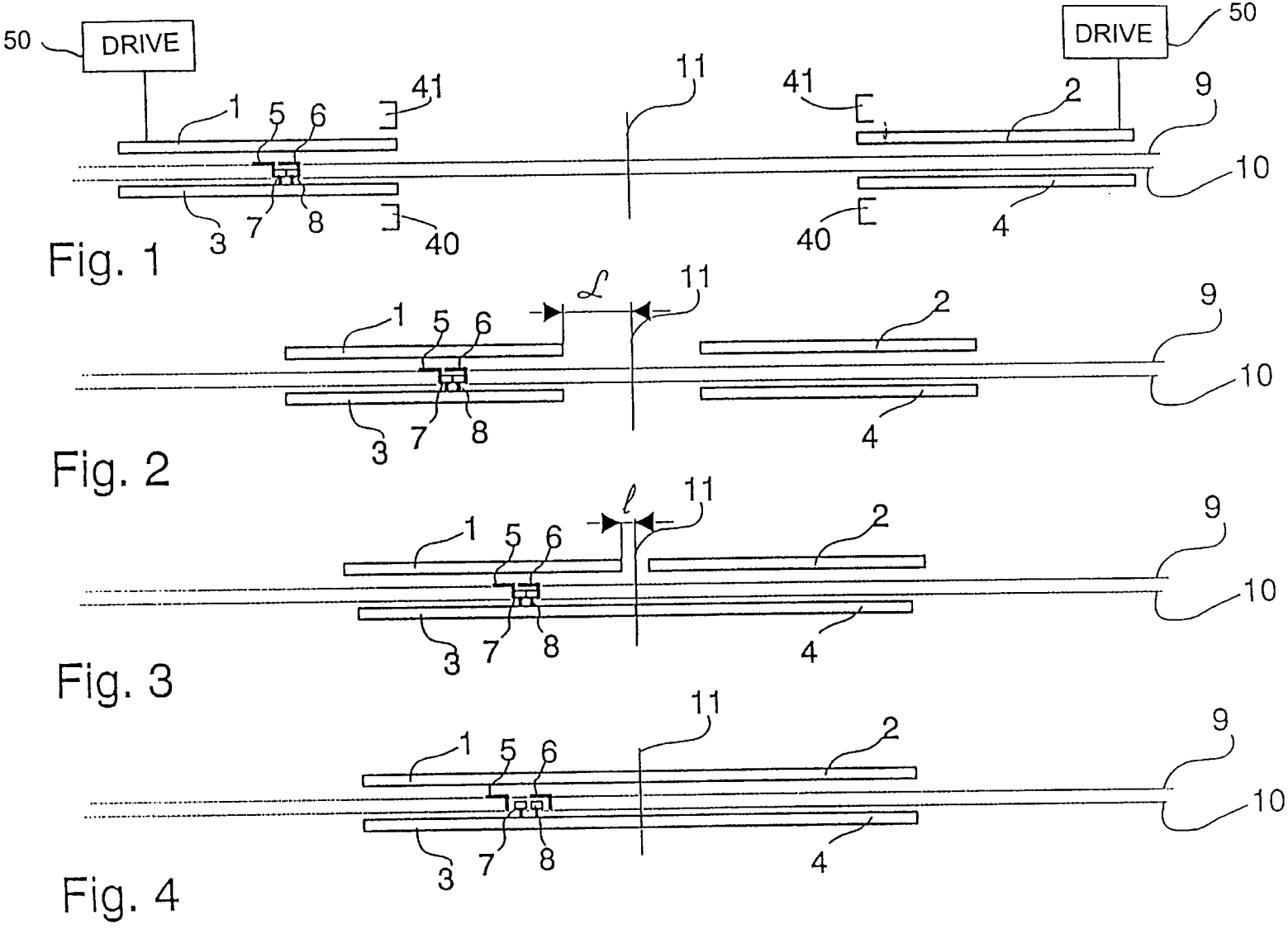
FIGS. 1–4 present different stages of the closing movement of a door applying the invention.

FIGS. 1–4 present different stages of the closing movement of a center-opening door applying the invention. The figures show the door panels 3,4 of the landing door and the door panels 1,2 of the car door as well as the vanes 5,6 constituting the gripping elements of the door coupler attached to the car door and the rollers 7,8 attached to the landing door, which are used as counterparts of the door coupler and which are engaged by the vanes as the latter are closed. In addition, each one of FIGS. 1–4 shows the sill lines 9,10 of the car door and landing door and the center line 11 of the door.

In FIG. 1, both the landing door and the car door are completely open. The door panels 3,4 of the landing door are aligned with the opposite door panels 1,2 of the car door. Preferably, both the landing door panels 3,4 and the car door panels 1,2 are in alignment with the landing door jambs 40 and the edges 41 of the car door opening. The edges of the door panels 1,2,3,4 being aligned with the edges 40,41 of the door opening creates a positive impression about the elevator. The door coupler vanes 5,6 hold the rollers 7,8 in their grip. When the door mechanism or drive 50 starts to close the car door, the closing movement of the landing door is also started, due to the action of the door coupler.

In FIG. 2, the doors are moving towards their closed position and have reached a point where the closing movement of the landing door is accelerated in relation to the closing movement of the car door. This point is at distance l from the position of a completely closed door panel. Distance l is preferably about 100 mm, which is sufficient for the landing door to advance ahead of the car door without requiring for this purpose a level of power that would necessitate stronger structures than usual in the door mechanism or other parts. In other words, up to this point, the landing door panels 3,4 have been moving in synchronism with the car door panels 1,2, but now they start moving ahead of the car door panels.

In FIG. 3, the two landing door panels have met each other. The car door panels 1,2 are still moving. When the landing door reaches the closed position, the car door panels 1,2 are at a distance l from the completely closed position. The distance l by which the landing door leads the car door at this stage is preferably about 20 mm, which, on the one hand, is long enough to ensure that the landing door is closed and, on the other hand, short enough to be achieved via a change in the operation or position of the door coupler. Through the door coupler, the movement of the car door panels causes the landing door panels 3,4 to be tightly pressed into their closed position, thus ensuring that the landing door is closed. As a result, the landing door is already completely closed before the car door is closed, and no further expedients to close the landing door are needed, which would only result in loss of time.

In FIG. 4, the car door panels 1,2 have met each other and the car door is completely closed. The door coupler vanes 5,6 have released the rollers 7,8 and the elevator car is ready to depart. The releasing movement of the vanes 5,6 may have already been started in the situation represented by FIG. 3.

Figure 7:
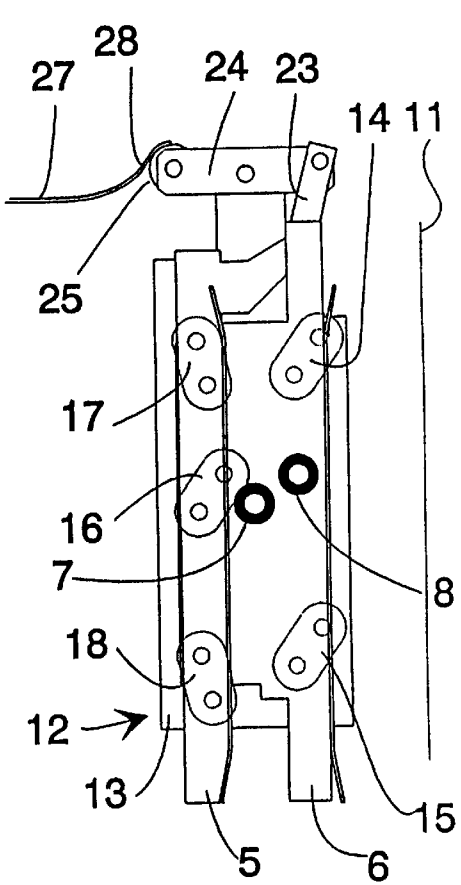
FIGS. 5–7 present the door coupler of the invention in different stages of the closing movement of a door applying the invention.
Figure 6:
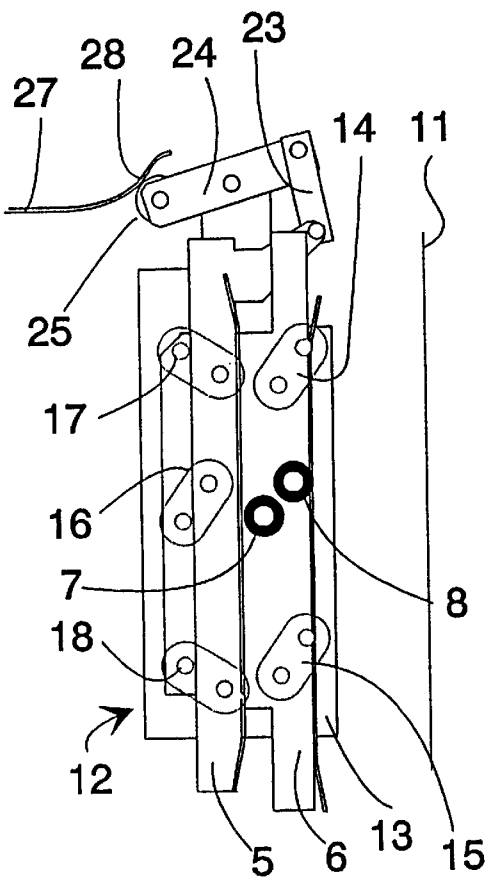
Figure 5:
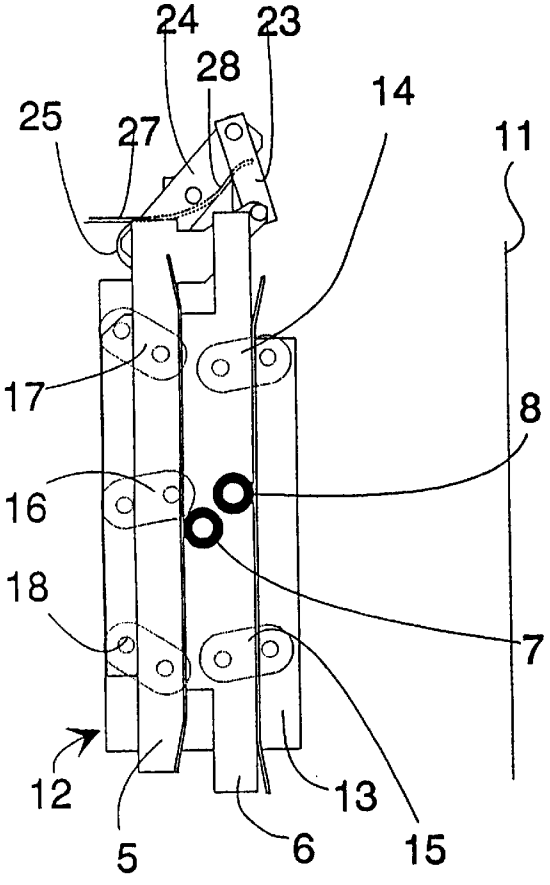
Figure 8:
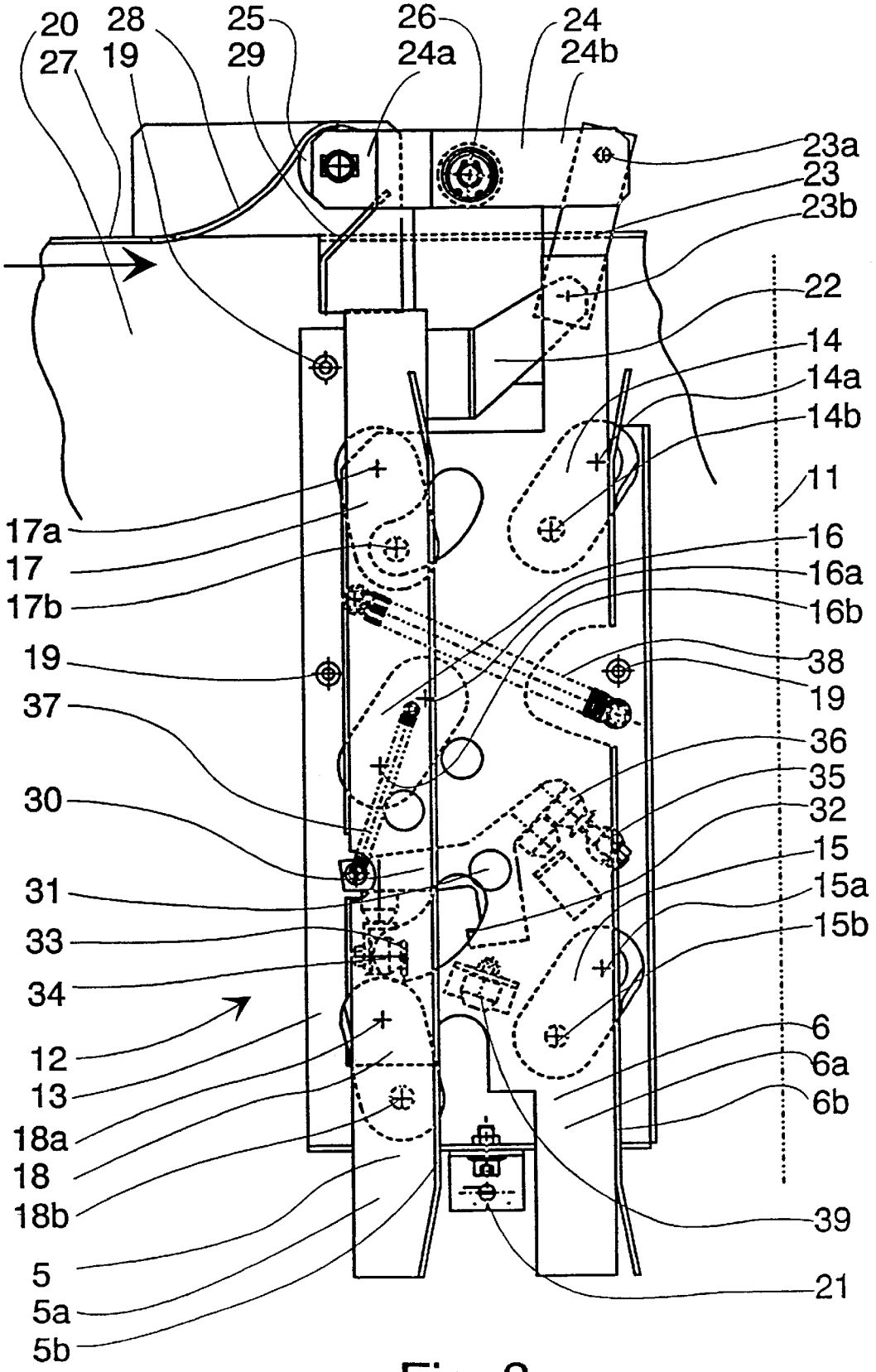
FIG. 8 presents the door coupler of the invention in greater detail.

FIGS. 5–7 present the door coupler in different stages of the closing movement of the door. FIG. 8 illustrates the composition of the door coupler in greater detail. The door coupler position in FIG. 5 corresponds to a situation as shown in FIG. 2; the door coupler position in FIG. 6 corresponds to a situation as shown in FIG. 3 and the door coupler position in FIG. 7 corresponds to a situation as shown in FIG. 4. In the situation depicted in FIG. 1, the door coupler position is also as in FIG. 6, except for the roller 25 reaching the ramp 28. FIGS. 5–7 also show the rollers 7,8 used as counterparts of the door coupler. The horizontal movement of the rollers 7,8 relative to each other or the landing door that takes place as the vanes press the rollers and again release them also actuates the lock of the landing door. When the rollers 7,8 are pressed between the vanes 5,6, the landing door lock is open. When the vanes 5,6 move apart after the landing door has been closed (FIG. 7), the rollers 7,8 also move apart. Sufficient clearances are provided between the rollers 7,8 and the vanes 5,6 to ensure that the rollers do not touch the vanes when the elevator car is moving past a landing door on its path.

FIGS. 5–7 present a series of successive stages of the process whereby the guiding effect produced by the upper guide track 27 on the roller 25 following it is converted via levers 23,24 into movements of the anterior 6 and posterior 5 door coupler vanes relative to the frame 13 of the door coupler 12. In the part corresponding to the final stage of the closing movement of the car door, the guide track 27 has a ramp 28 with an upward curvature. In FIG. 5, the roller 25 is reaching the ramp 28 of the guide track 27. In the situation in FIG. 5, the acceleration of the landing door is about to begin. In FIG. 6, the roller 25 has moved through some distance upwards along the ramp 28 and, while moving upwards, it has caused the levers 23 and 24 to turn, thereby lowering the vanes 5,6. The downward movement of the vanes causes the links 14,15,16 supporting the vanes 5,6 on the base plate 13 forming the frame of the door coupler to turn, with the result that the vanes 5,6 move in relation to the base plate in the closing direction of the door. At this stage, a blocking lever 30 still prevents the vanes from moving apart. Since the base plate 13 is attached to the car door and the vanes 5,6 are coupled via the rollers 7,8 to the landing door, the movement of the vanes 5,6 relative to the base plate 13 in the closing direction results in the landing door moving ahead of the car door. In FIG. 7, both the landing door and the car door are closed. The door coupler vanes 5,6 have released the rollers 7,8 and the elevator car can depart. The opening motion of the vanes 5,6 is effected by releasing the movement of the vanes relative to each other and letting vane 5 to move downwards with respect to vane 6, so that the links 17,18 connecting vane 5 to vane 6 turn, thereby moving vane 5 farther away from vane 6. The vanes only start moving apart after the landing door has been closed.

FIG. 8 shows the door coupler 12 in a situation where the elevator doors have reached the center line 11, which is the terminating point of the closing movement of the doors, and the door coupler vanes 5,6 have been opened. The structure and operation of the door coupler are described in greater detail by referring to FIG. 8. The door coupler vanes 5,6, which in this figure are in their open position, are placed on the base plate 13 forming the frame of the door coupler, the anterior vane in the closing direction of the door (the right-hand vane in the figure) 6 being connected via links 14,15,16 by its portion 6*a* parallel to the base plate 13 to the base plate of the door coupler while the posterior vane 5 in the closing direction of the door is connected via other links 17,18 by its portion 5*a* parallel to the base plate to the anterior vane part 6*a* parallel to the base plate. Using screws or other means, the door coupler 12 is attached by its frame 13 to the supporting plate 20 of the car door. It is also possible to mount the door coupler on the door panel of the car door by using suitable fixing elements 21, in which case the frame 13 of the door coupler 12, the supporting plate 20 and the car door form a fairly rigid structure without any separate reinforcements. The anterior vane is suspended on the frame 13 by means of first links 14,15,16. The first end of each link is pivoted on the frame 13 via a joint 14*a*,15*a*, 16*a* while the second end of each link is pivoted on the part 6*a* of the anterior vane 6 parallel to the frame via a joint 14*b*,15*b*,16*b*. In each first link, the distance between the first pivot 14*a*,15*a*,16*a* and the second pivot 14*b*,15*b*,16*b* is the same. The first links 14,15,16 remain parallel to each other while turning as the anterior vane moves in relation to the frame 13 when the gap between the door coupler vanes 5,6 is being opened or closed. Therefore, the part 6*b* of the anterior vane which engages roller 8 on the landing door always remains in a substantially vertical position.

The posterior vane 5 is suspended on the anterior vane 6 by means of second links 17,18. The first end of each link is pivoted on the anterior vane 6 via a joint 17*a,*18*a* and similarly the second end on the part 5*a* of the posterior vane 5 parallel to the frame of the door coupler via a joint 17*b*,18*b*. In each second link 17,18, the distance between the first pivot 17*a*,18*a* and the second pivot 17*b*,18*b* is the same. The second links remain parallel to each other while turning as the posterior vane moves in relation to the anterior vane when the gap between the door coupler vanes 5,6 is being opened or closed. Therefore, the part 5*b* of the posterior vane which engages roller 7 on the landing door always remains in a substantially vertical position. The posterior vane 5 is provided with a lug 22 to which the lever 23 is connected via a second pivot 23*b* at its second end. At the first end of the lever 23 is a pivot 23*a,* by which the lever is connected to the second end 24*b* of a rocker arm 24. The lever 23 transmits the motion of the rocker arm 24 to the posterior vane via the lug 22. Mounted with a bearing on the first end 24*a* of the rocker arm is a roller 25. Between its first end 24*a* and second end 24*b,* the rocker arm 24 is supported by a pivot 26 attached to the base plate 13 or immovably mounted in relation to the base plate. As the door coupler 12 moves with the car door, the roller 25 follows a guide track 27 above the roller provided in the overhead supporting beam on which the car door is suspended. In the part corresponding to the final stage of the closing movement of the car door, the guide track 27 has a ramp 28 with an upward curvature. In the figure, the direction of the closing movement of the door is indicated with an arrow below the guide track 27. In case the roller 25 should for some reason, e.g. because of a malfunction, fail to follow the upper ramp 28, the overhead beam is also provided with a lower ramp 29, which in this case would meet the roller at the end of the closing movement, forcing it up and 25 thus producing the movement of the rocker arm 24.

By means of the blocking lever 30, the gap between the door coupler vanes 5,6 is kept closed against the landing door rollers 7,8 between the vanes 5,6 during the closing and opening movements. The blocking lever 30 is pivoted on the anterior vane 6 by joint 31. When the vanes are in their closed position, the blocking lever 30 holds fast on a stop block 33 with its claw 32. The stop block 33 is also utilized to limit the opening movement of the posterior vane 5. When the vane 5 is in its completely open position, the stop block 33 rests against a stop buffer 34 limiting the opening movement of the posterior vane. The closing movement of the vane 5 is limited by a stop buffer 39 limiting the closing movement of the posterior vane 5, link 18 meeting said stop buffer 39 at the end of the closing movement of the posterior vane. When the door reaches its closed position, the movement of the anterior vane 6 is stopped by a stopper 35 mounted on the base plate, which stopper 35 meets a buffer 36 attached to the blocking lever. The blocking lever 30 now turns so that the claw 32 of the blocking lever releases the stop block 33 and a spring 37 pulls the posterior vane 5 into its open position. The spring 37 is attached by its first end to a third arm of the blocking lever and by its second end to the posterior vane 5. The claw 32 is mounted on the second arm of the blocking lever and the buffer 36 is mounted on the first arm of the blocking lever. In the open position of the door, the spring keeps the blocking lever 30 in a position where the claw is able to engage the stop block 33. The position of the blocking lever 30 where the stop block 33 is engaged is the extreme position during its operation in the clockwise direction. The stopper 35 again presses the blocking lever into the other or opposite extreme position. In addition to pulling the posterior vane 5 into its open position at the end of the closing movement of the door and maintaining the grip of the claw 32 on the stop block 33 when the door is open, the spring 37 also applies a certain force to the door when the door is closed, helping to keep the door in its closed position. One end of the spring 37 is attached to the posterior vane 5 and the other end to the blocking lever 30 so that it pulls the blocking lever towards the position where the stop block 33 is engaged, and also pulls vane 5 towards its open position. In FIG. 6, a portion of the anterior vane 6 has been cut away to show the first end of an actuating spring 38. The first end of the actuating spring 38 is attached to the base plate 13 and the second end to the anterior vane 6 so that the spring pulls the anterior vane in the closing direction of the door. By the agency of the actuating spring 38, the door coupler vanes 5,6 are moved with respect to the door coupler frame 13 in the closing direction of the door, while at the same time the roller 25 pressed against the ramp 28 moves upwards along the ramp. Thus, the door coupler moves the rollers 7,8 attached to the landing door and therefore the landing door itself in the closing direction in relation to the car door.

The door coupler vanes 5,6 are only opened after the landing door has been closed. Guided by the ramp 28, the vanes 5,6 have moved into a position where the blocking lever has released its grip on the stop block 33, permitting the vanes to open. Using the tension of the spring 37 and the remaining distance l the whole car door still may have to move before reaching the completely closed position to guide the opening movement of the vanes, the vanes are opened so as to release the rollers. As the distance available for opening the vanes is relatively long, as long as 20 mm or over, the vanes can be moved relatively far apart. In this way, a clearance 2–3 times as large as in conventional door couplers between the door coupler vanes and the rollers on the landing door can easily be achieved.

Figure 9:
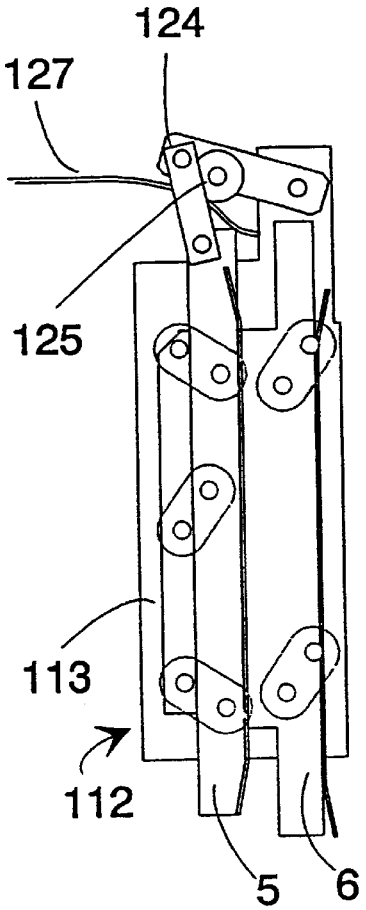
FIG. 9 presents another door coupler applying the invention.

FIG. 9 presents a door coupler 112 in which the movement of the vanes 5,6 relative to each other and the base plate 113 is controlled by a roller 125 following a guide track 127. In the part corresponding to the final stage of the closing movement of the door, the guide track has a ramp with a downward curvature. The guide track is located in the overhead supporting beam of the car door or in some other suitable place above the car door. The guide track is immovably fixed relative to the elevator car. The roller 125 runs on the upper surface of the guide track 127. The vertical motion of the roller 125 produced by the ramp is transmitted via a linkage 124 to actuate the vanes 5,6.

Figure 10:
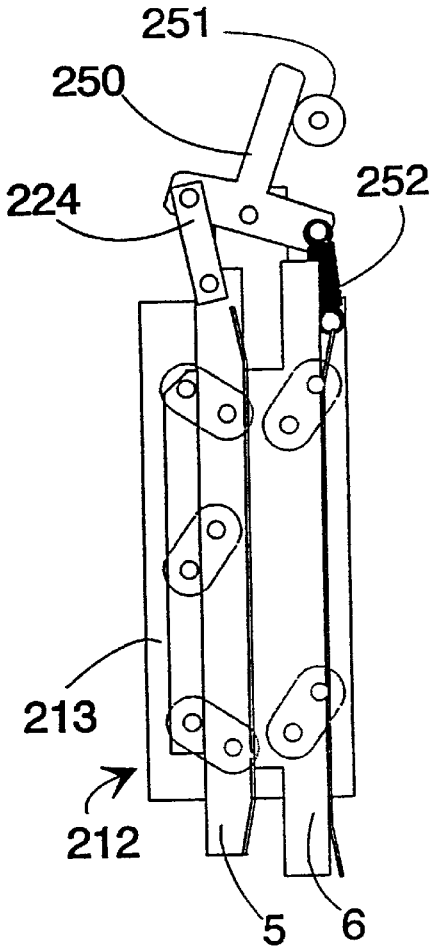
FIG. 10 presents a third door coupler applying the invention.

In the door coupler 212 presented in FIG. 10, the control of the vanes required for advancing the landing door ahead of the car door is implemented using a solution other than a ramp in the overhead supporting beam of the car door. A counterpart 251, preferably a roller, is immovably mounted in relation to the car door, e.g. on the overhead supporting beam of the car door. The door coupler comprises a linkage 224 connected to the vanes 5,6 and having its fulcrum on the frame 213. The linkage includes a coupling part 250 which, when pressed against the counterpart 251 as the door is being closed, changes the position of the linkage 224. Via the linkage and by the agency of the door movement, the coupling part being pressed against the counterpart causes the vanes 5,6 first to move in the closing direction of the door and then to open. Connected to the linkage 224 is a return spring 252, which tends to resist the change produced in the linkage by the coupling part 250 being pressed against the counterpart 251 and return the linkage to the condition that prevailed before the change.

Of the door coupler solutions presented above, those employing a ramp are more reliable and less noisy than the door coupler in FIG. 10. Of the door coupler solutions employing a ramp, the one using a roller or other follower running below the ramp is preferred to the one using a roller or other follower running above the ramp, because in the former case any dust or dirt accumulating on the guide track will not affect the control of the door coupler movement. However, obviously most of the functional features of and advantages achieved by the door coupler illustrated by FIGS. 4-8 also apply in the case of the door couplers in FIG. 9 and 10, although these have a different mechanical structure.

Figure 11:
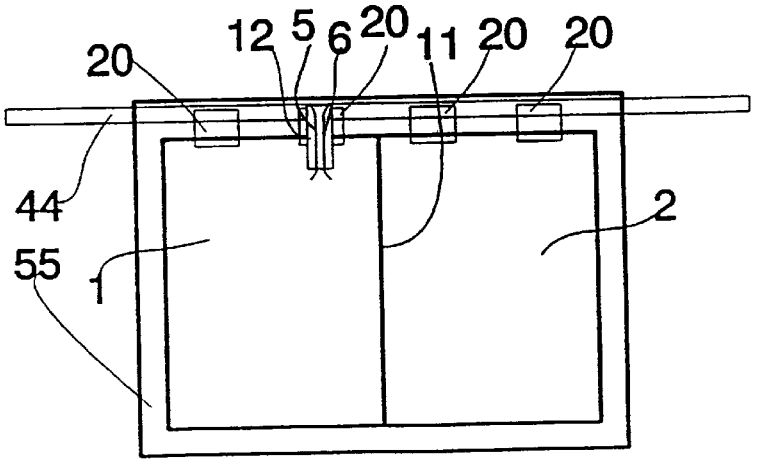
FIG. 11 presents an elevator car as seen from the side of the doors.

FIG. 11 presents an elevator car 55 with an overhead supporting beam 44 on which the door panels 1,2 of the car door are suspended using car door supporting plates 20.

The door coupler 12, of which only the vanes 5,6 and an outline are shown, is mounted on the second supporting plate of the left-hand door panel. The figure does not show the door operating mechanism and the equipment transmitting the operating power to the door.

It is obvious to a person skilled in the art that different embodiments of the invention are not restricted to the examples described above, but that they may instead be varied in the scope of the claims presented below. For instance, the door coupler may be mounted in some other place on the car door than on the supporting plate. Regarding the inventive idea, the number of door panels comprised in the door is not important, nor is it important whether the door is of a side-opening or a center-opening type. It is also obvious to the skilled person that the described functions of the door coupler and the door occur in opposite directions when the door is being opened and when the door is being closed.

I claim:

1. A procedure for closing an elevator landing door wherein the landing door is coupled with an elevator car door by a door coupler, the method comprising the steps of:

moving the car door by a drive mounted in conjunction with the elevator car;

moving the car door and the landing door during an initial stage of closing movement at a same speed, the car door and the landing door starting movement simultaneously; and moving the landing door at least temporarily faster than the car door during a final stage of closing movement.

2. The procedure as defined in claim 1, further comprising the steps of:

moving the car door and the landing door side-by-side during the initial stage of the closing movement; and moving the landing door ahead of the car door during the final stage of the closing movement.

3. The procedure as defined in claim 2, further comprising the step of using the drive acting only on the car door to move both the landing door and the car door.

4. The procedure as defined in claim 3, wherein the step of moving the landing door at least temporarily faster than the car door further comprises using moving gripping elements in the door coupler, the gripping elements being moved in relation to the car door and movement of the gripping elements being controlled on a basis of a position of the car door.

5. The procedure as defined in claim 2, wherein the step of moving the landing door at least temporarily faster than the car door further comprises using moving gripping elements in the door coupler, the gripping elements being moved in relation to the car door and movement of the gripping elements being controlled on a basis of a position of the car door.

6. The procedure as defined in claim 1, further comprising the step of using the drive gear acting only on the car door to move both the landing door and the car door.

* * * * *